United States Patent [19]

Shemenski

[11] Patent Number: 4,508,763

[45] Date of Patent: Apr. 2, 1985

[54] PROCESS AND PATTERN FOR DECORATING CYLINDRICAL ARTICLES

[76] Inventor: Kenneth L. Shemenski, Spragueville Rd., Smithfield, R.I. 02917

[21] Appl. No.: 529,502

[22] Filed: Sep. 6, 1983

[51] Int. Cl.[3] ..... B05D 1/36

[52] U.S. Cl. ..... 427/262; 427/355

[58] Field of Search ..... 427/262, 263, 267, 268, 427/355

[56] References Cited

U.S. PATENT DOCUMENTS

| | | | |
|---|---|---|---|
| 2,877,588 | 3/1959 | Ernst | 427/262 |
| 2,962,385 | 11/1960 | Rees et al. | 427/267 |
| 3,707,445 | 12/1972 | Green | 427/268 |
| 4,105,816 | 8/1978 | Hori | 427/262 |
| 4,298,634 | 11/1981 | Phelps | 427/355 |
| 4,388,350 | 6/1983 | Ayers | 427/267 |

*Primary Examiner*—James J. Bell

*Attorney, Agent, or Firm*—Robert J. Doherty

[57] ABSTRACT

A process and pattern for producing a variegated swirl pattern upon the outer surface of cylindrical metal articles such as pen barrels and the like in which a first lacquer coating is spray applied and then a second lacquer pattern applied thereto a distinctive rolling technique utilizing unpatterned lint-free textile material which has been folded upon itself as the application medium. The second and decorative coating is normally of a similar lacquer material but of a darker color than the first coat and is applied by a rolling technique in which the cylindrical article is moved in longitudinal contact with the pattern so as to impart a variegated, one-of-a-kind, leather simulating overall appearance to the article.

8 Claims, 3 Drawing Figures

FIG. 1
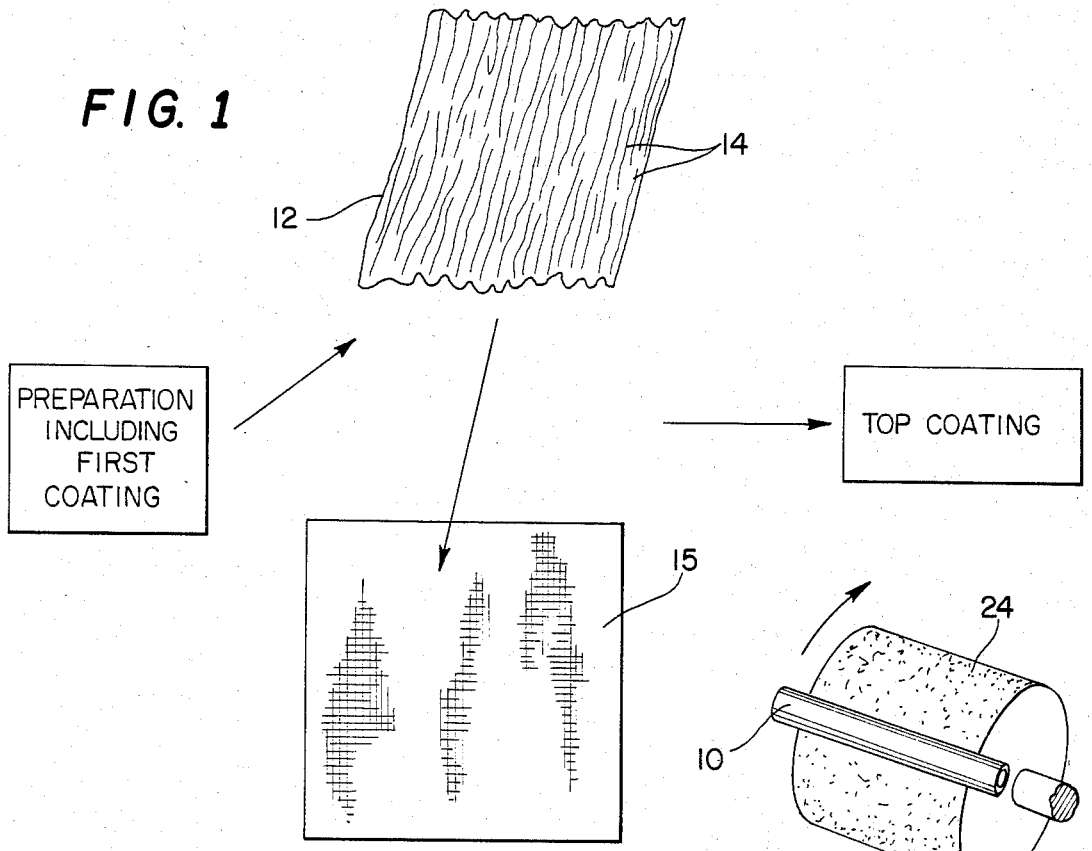
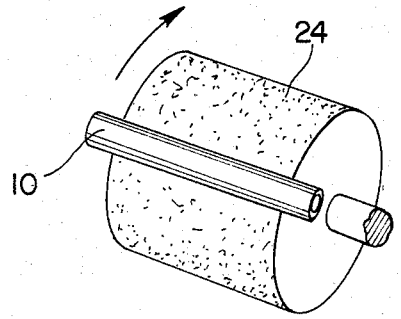
FIG. 2
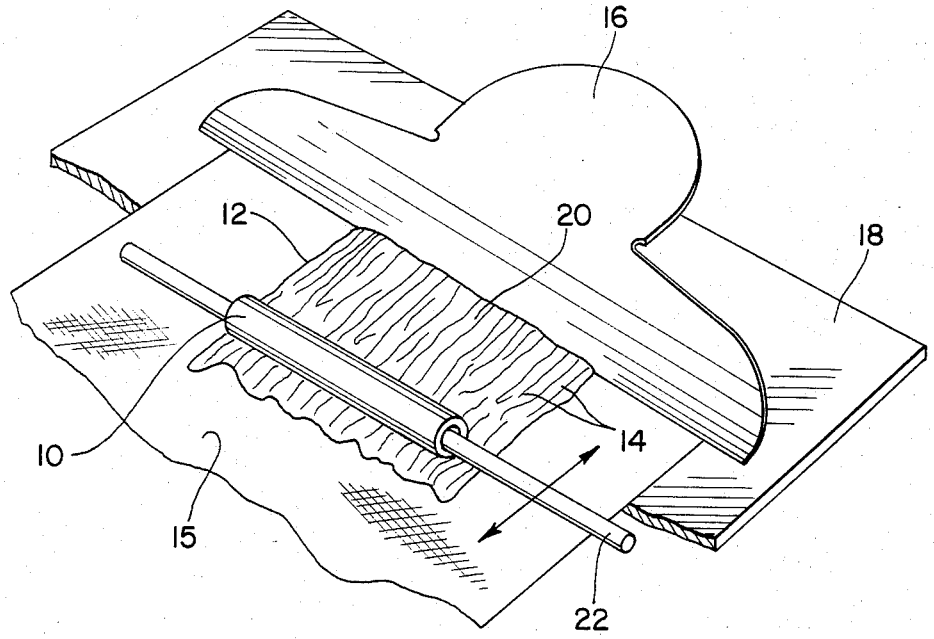
FIG. 3

PROCESS AND PATTERN FOR DECORATING CYLINDRICAL ARTICLES

BACKGROUND AND OBJECTS OF THE INVENTION

This invention deals with a method of applying a novel variegated decorative coating to the outer surface of a cylindrical article such as a pen barrel or the like as well as to a novel pattern, mold, or application device for so applying such decorative coating. It is common in decorating pen barrels and other cylindrical objects to attempt to produce a simulated leather grain or variegated appearance similar to hand applied lacquer or jappaned surfaces. Such has been attempted by the application of various lacquer coatings applied by stencils, molds, and the like to achieve such simulated results but the need remains for a relatively fast, inexpensive technique suitable for mass production whereby decorative surfaces which satisfactorily resemble hand-applied coatings are achieved in an economical manner.

It is, accordingly, the primary object of the present invention to present a technique to accomplish such above-indicated results.

A further object of the present invention is the provision of a pattern device by which a novel variegated pattern simulating an expensively applied hand-decorated surface is achieved with readily available and synthetic bake dry state of the art polymer materials referred to as lacquers and enamels which impart high quality wear and use characteristics not available with air dry nitrocellulose-type lacquers.

These and other objects of the invention are accomplished by providing a patterning pad for imparting a variegated lacquer pattern to a cylindrical surface which when wetted with a pigmented lacquer and applied in a longitudinal rolling motion over an already applied at least partially cured lacquer coating enables such desired decorative coating to be achieved.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a diagramatic view illustrating various steps in the process of the present invention;

FIG. 2 is a perspective view of a buffing wheel and its utilization therein; and FIG. 3 is a perspective view showing the novel patterning pad and the manner in which articles are decorated thereby.

DESCRIPTION OF THE INVENTION

The present invention will be described in relationship to the decoration of a hollow metal article such as a portion of a pen barrel. It should be brought out, however, that other articles may be decorated by the process and pattern of the present invention including, for example, food surface utensils such as cutlery, flashlight bodies, and the like and that the term cylindrical as used herein refers to an article which has a circular or at least partially circular outer surface and which is rollable over the pattern of the present invention in the intended manner.

Turning now to the drawing, pen barrels or other articles 10 formed from suitable non-metallic or metallic materials such as brass, are initially prepared for the receipt of a first coating of lacquer in what is normally the application of a three-coating application thereto so as to produce a highly decorative overall finish to the outer surface of the pen barrel or article 10 and one in which such appearance is retained, that is, the appearance will last under normal usage of the article to which such is applied. Such preparation may include the chemical cleaning of the surface to be decorated and thereafter the spray application of the initial decorative coat by a suitably solvent-thinned, resin material which is then at least partially cured and prepared for the application of a second and decorative coating. The pattern of variegated decorative appearance of the second coating is accomplished through the manner of application in combination with a unique patterning or application device where a similar resinous material is deposited over the first coating and, accordingly, forms the second coat. Such decorative or second coating is made up of a similar resinous material as to that forming the first coating and of a substantially different color or shade such that the variegated or patterned effect achieved through the novel patterning pad of the present invention is clearly visible. Thereafter the second coat is at least partially cured and a third generally transparent coating of a harder protective resin is applied thereover by spray techniques after which a final cure is achieved and the resultant finished parts assembled for intergration into completed pens.

As previously indicated, other cylindrical objects may be treated in accordance with the aforesaid techniques of this invention and that when applied to pens both those parts commonly referred to as pen barrels and pen caps are similarly treated to provide an aesthethically pleasing end result. It has been found in addition to the above-indicated treatment and coating stages that intermediate preparation including air blowing the surface of the articles with ionized air prior to each coating step as well as certain buffing techniques in order to eliminate or minimize dust adherence and to achieve better adherence between coats as by molecular excitation of the previous surface coating have been found to be helpful in achieving the desired results of the present invention. In addition, general housekeeping of the plant environment including the establishment of a clean room for the application of the decorative coating in which entering air is filtered and the like contribute to the minimization of dust adherence to any of the multiple coating layers applied to the surface of the articles 10 being decorated.

The manner in which the decorative coating is applied is particularly important to the present invention and in that regard it has been found that the use of non-woven unpatterned mercerized lint-free textile material which is highly absorbent to the coating material, generally a laquer the composition of which will be more completed disclosed hereinafter, is ideally suited for the formation of the pattern pad. Such material is folded upon itself along a plurality of irregularly longitudinally directed lines 14 so as to achieve a somewhat accordianlike fold and held in such condition by appropriate means such as a conventional spring clamp 16. Thus by reference to FIG. 3 in particular, it may be seen that a clip board or similar article 18 having clamp 16 attached thereto may be utilized not only to suitably secure the pad 12 to a horizontal surface as by contacting edge portions thereof along a line 20 but further display the pad 12 in a generally horizontal position such that the pen barrel or other article 10 may be rollingly manipulated longitudinally thereon such that lacquer absorbed in the pad 12 may be applied to the outer surface of the article 10 in the intended manner. This application is achieved by a back and forth rolling action of the pen barrel or article 10 longitudinally along the pad 12 after the pad has been impregnated or wetted with a suitable pigmented lacquer material similar to the lacquer forming the base coat applied to the article. Normally the second lacquer material forming the second decorative layer is of a similar color but materially darker shade than that forming the first layer. A rod 22 extending entirely through the pen barrel or article 10 may be used to conveniently roll the article back and forth along the pad without necessitating the touching of the outer decorative surface formed by such action. Such manipulation of the outer ends of the rod 22 may be by trained personnel although it is contemplated that mechanization or automation of such longitudinal back and forth motion could be achieved.

After an amount of second coating material has built up on the outer surface of the article 10 such that a variegated or patterned appearance is present in which the first or initial coating is clearly visible in selected areas and while the second coating is still wet, the article is removed from the pad and immediately lightly blotted by a similar longitudinal rolling contact with a lacquer absorbent cloth 15 and thereafter stacked for at least partial curing. After the decorative or second coating has been applied and is at least partially cured, the third or top coating is applied of a resin material generally having a harder surface and, accordingly, being more durable than the decorative layers is spray coated thereover and thereafter the entire top coated decorative article cured. The top layer should, of course, be chosen for its abrasion and wear characteristics and may or may not be compatible with materials forming the underlying layers. It has also been found that it is beneficial to buff the exterior surface of the article after having received the first two decorative layers and which have been at least partially and preferably well cured with a revolving standard buffing wheel 24. It is believed that such treatment excites or in some way alters the molecular structure of the decorative layers such that the receipt of a protective top layer generally which is translucent and preferably transparent may be received.

EXAMPLE 1

A specific example of accomplishing the aforementioned results is as follows: Brass cylindrical pen barrels were initially prepared by degreasing in Tri-ethane at elevated temperature. The barrels were then water rinsed in tap water by dipping and then chemically dioxidized by dipping at room temperature in a bath of Dyoxit from Dytex Chemical Company. The barrels were then water rinsed, dried with hot air and thereafter placed on metal racks preliminary to receiving the initial lacquer coating. Prior to receiving the initial lacquer coating, the degreased and cleaned barrels were blown with ionized air to break the static charge from the surface of the article so the surface will not attract dust and the like. The articles were then hand sprayed with a melamine-alkyd resin suitably thinned with standard solvents to eighteen second viscosity on a Zahn #2 cup so as to enable mist dispersion from a standard pressurized spray gun. The specific resin utilized is a melamine-alkyd resin from Spectrum, Inc. of Providence, Rhode Island identified as No. 21061 Brown and further identified as a 28% alkyd, 5% melamine, 5% urea resin mix with a 2% butonol, 16% xylol, 22% aliphatic naptha, and 22 assorted pigments.

Immediately after spraying, the metal racks were placed in an oven at 330° F. to flash off the solvents to reduce tackiness so as to prevent dust adhesion. The initial coating, that is, the base coating was then cured at 310° F. for twenty minutes. In this regard, it is believed necessary to at least partially cure the base coating at a temperature of 310° F. It is desirable not to overcure the initial coating because a coating that is too brittle or excessively cured may produce a surface tension in the base coating such that the second coat will not readily adhere thereto while still necessarily holding the pattern imparted to it by the hand rolling application.

The variegated decorative or swirl coat, that is, the second coat, was then applied directly over the first coat by hand rolling application as previously described above on a pattern pad 12 soaked with a lacquer solution and a final blotting roll over a clean cloth to remove the excess material and bubbles, if any. The human operators added solvent or thinner, changed pattern pads, and clean absorbent cloths and varied the number of passes back and forth in a longitudinal direction so as to insure that a swirled variegated patterned appearance of a second lacquer coating material was achieved over the initial base coat yet portions of the initial base coat observable thereunder. The particular lacquer material used was a melamine-alkyd similar to the base coat resin and identified as No. 20660 from Spectrum, Inc. The second coating lacquer material was a dark brown whereas the initial coat was a lighter brown. Toluene thinner and Butyl Cellosolve solvent as flow additives were added to insure that the patterning pad 12 was properly wetted. The pad was formed from a disposable wiper identified by the tradename "Kimwipes" manufactured by Kimberly Clark Corporation, Neenah, Wisconsin 54956. The absorbent cloth utilized to blot the excess decorative second coating was a cotton cloth, bleached, unsized and mercerized and available as Style 400M printcloth from Testfabrics Incorporated, Middlesex, N.J. 08846.

The articles 10 after the application of the second coating were racked as previously described and cured or partially cured in an oven at 310° F. for twenty minutes. After cooling, the decorated articles were buffed by a dry hand buffing technique utilizing a standare cotton disc buffing wheel to prepare the surface for application of a final and protective top coat. It is believed that the buffing alters the molecular structure or in some way wets the surface so as to enable the top coat to flow across and more permanently adhere to the decorative first and second coatings. As with the previous coating applications, the articles were blown with ionized air to reduce dust and thereafter hand sprayed using a standard spray gun with an epoxy-urea baking material identified as No. 3327/66 from Technical Coatings Lab. Such top coat resin material was suitably thinned with a lacquer thinner identified as No. 2907/66 also from Technical Coatings Lab and thereafter cured in an oven for twenty to fifty minutes at 350° F. The top coat thickness is preferably at least of a 3 mill thickness. All of the thus produced articles were found to have an extremely durable top coating and visually appearing as a combination dark and light brown variegated pattern resembling leather and the like.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims. Also as used herein, the term lacquer encompasses resin materials sometime referred to as enamels.

What is claimed is:

1. The process of lacquer decorating the outer surface of a metal generally cylindrically-shaped article such as a pen barrel, flashlight body, and the like comprising, coating said outer surface with a first lacquer, curing said first lacquer coat and thereafter decorating said surface with a second substantially similar lacquer of a substantially different color or shade than said first lacquer in a variegated pattern, said decorative pattern being applied by supporting said article for free rotation and thereafter lightly rolling said article in longitudinal contact with the upper surface of a patterning pad formed from a planar sheet of unpatterned, lint-free textile material which has been folded upon itself along a plurality of irregular longitudinally directed lines and wetted with said second lacquer coat so as to impart said variegated pattern to said article and thereafter immediately roll blotting said thus decorated article on a sheet of lacquer absorbent cloth and thereafter curing said second lacquer coat, wherein said first and second lacquers are melamine-alkyd resin mixtures.

2. The process of lacquer decorating the outer surface of a metal generally cylindrically-shaped article such as a pen barrel, flashlight body, and the like comprising, coating said outer surface with a first lacquer, curing said first lacquer coat and thereafter decorating said surface with a second substantially similar lacquer of a substantially different color or shade than said first lacquer in a variegated pattern, said decorative pattern being applied by supporting said article for free rotation and thereafter lightly rolling said article in longitudinal contact with the upper surface of a patterning pad formed from a planar sheet of unpatterned, lint-free textile material which has been folded upon itself along a plurality of irregular longitudinally directed lines and wetted with said second lacquer coat so as to impart said variegated pattern to said article and thereafter immediately roll blotting said thus decorated article on a sheet of lacquer absorbent cloth and thereafter curing said second lacquer coat, wherein a hard protective clear resin top coat is spray applied over said cured second lacquer after said cured second lacquer coat is dry buffed.

3. The process of claim 2, said top coat is an epoxyester resin.

4. The process of claim 1, said first lacquer coat being spray applied to said metal surface.

5. The process of claim 4, wherein said metal surface is initially degreased, chemically cleaned water rinsed, air dried, and blown with ionized air prior to spray coating thereof.

6. The process of claim 5, said first lacquer spray coating being a resin mixture of approximately 28% alkyd, 5% melamine and 5% urea resins with about 22% pigment colorants with the remainder being a solvent mixture, said spray coating cured at approximately 310° F. for twenty minutes, said decorative pattern then applied to said thus coated article and thereafter said composite layered article cured at approximately 310° F. for twenty minutes, the thus decorated and cured composite layered article then buffed with a dry cotton disc buffing wheel and then coated with an outer generally clear protective coating by spray deposition and curing thereof.

7. The process of claim 6, said protective top coating being an epoxy-urea resin.

8. The process of claim 6, wherein the outer surface of the article is dusted prior to receiving each spray coat by blowing ionized air thereover.

* * * * *